US005815129A

United States Patent [19]

Jung

[11] Patent Number: 5,815,129

[45] Date of Patent: Sep. 29, 1998

[54] LIQUID CRYSTAL DISPLAY DEVICES HAVING REDUNDANT GATE LINE DRIVER CIRCUITS THEREIN WHICH CAN BE SELECTIVELY DISABLED

[75] Inventor: Byung-hoo Jung, Seoul, Rep. of Korea

[73] Assignee: Samsung Electronics Co., Ltd., Rep. of Korea

[21] Appl. No.: 758,649

[22] Filed: Nov. 27, 1996

[30] Foreign Application Priority Data

Dec. 1, 1995 [KR] Rep. of Korea ..... 1995/46034
Dec. 30, 1995 [KR] Rep. of Korea ..... 1995/69702

[51] Int. Cl.[6] ..... G09G 3/18

[52] U.S. Cl. ..... 345/93; 345/98; 345/100; 345/103; 345/904

[58] Field of Search ..... 345/93, 103, 904, 345/98, 100

[56] References Cited

U.S. PATENT DOCUMENTS 4,789,857 12/1988 Maurice ..... 345/93
4,822,142 4/1989 Yasui ..... 345/103
5,034,736 7/1991 Bennett et al. ..... 345/100
5,063,378 11/1991 Roach ..... 345/90
5,075,674 12/1991 Katayama et al. ..... 345/93
5,113,134 5/1992 Plus et al. ..... 324/770
5,223,824 6/1993 Takeda et al. ..... 345/93
5,555,001 9/1996 Lee et al. ..... 345/93

*Primary Examiner*—Steven J. Saras
*Assistant Examiner*—Vincent E. Kovalick
*Attorney, Agent, or Firm*—Myers Bigel Sibley & Sajovec, P.A.

[57] ABSTRACT

A liquid crystal display including a driving circuit is provided. The LCD in which one gate line is driven by both left and right gate drivers includes a couple of switching means which are placed between the gate driver and gate line, the couple of switching means being activated and deactivated by switching control signals to switch the output of the gate driver. When one of the gate drivers does not operate, the output of the gate driver having the operational problem is prevented from being applied to the gate lines, by a switching operation. Therefore, even when only one of gate drivers operates, the display panel can function properly, thereby preventing the lowering of picture quality and improving product yield.

12 Claims, 8 Drawing Sheets

LIQUID CRYSTAL DISPLAY DEVICES HAVING REDUNDANT GATE LINE DRIVER CIRCUITS THEREIN WHICH CAN BE SELECTIVELY DISABLED

BACKGROUND OF THE INVENTION

The present invention relates to a liquid crystal display (LCD), and more particularly, to an LCD having an improved redundancy function.

Since the need for a portable flat display has increased, many portable flat displays have been developed. Particularly, an LCD is commonly used as a typical flat display.

The LCD is classified into an a-Si TFT LCD adopting amorphous silicon thin film transistors, and a p-Si TFT LCD adopting polysilicon thin film transistors in which a driving circuit is integrated in the same substrate as the thin film transistor (TFT). In the case of the p-Si TFT LCD, a high quality picture can be obtained and the driving circuit can be integrated on the same substrate without an additional driver IC, providing many advantages.

FIGS. 1A and 1B are block diagrams of a conventional p-Si TFT LCD including a driving circuit.

FIG. 1A is a block diagram showing the structure of the most general LCD. Reference numeral 10 represents a pad array, reference numeral 20 represents a gate driver, reference numeral 30 represents a data driver, and reference numeral 40 represents a display panel.

The gate driver 20 designates a gate line on which a data signal is to be loaded by making a scan pattern.

The data driver 30 processes a control signal transmitted from a control circuit (not shown) and designates a column line of a display panel.

The display panel 40 is constituted by a pixel array formed of the p-Si TFT in which a pixel is designated by the gate driver 20 and the data driver 30.

In the LCD shown in FIG. 1A, the gate driver 20 is connected to the left or right side of the display panel 40, so that the gate lines are driven by one gate driver.

In FIG. 1B, however, gate drivers 20*a* and 20*b* are connected to both the left and right sides of the display panel 40, so that the gate lines are driven by two gate drivers. In the structure of FIG. 1B, with a redundancy structure for improving product yield, each gate line is connected to both the left and right gate drivers 20*a* and 20*b*. If one of the left and right gate drivers does not operate, the display panel 40 is driven by only one normal gate driver. That is, even though one of two gate drivers is abnormal, the display panel 40 can be driven.

FIG. 2A is a block diagram of a typical gate driver of the conventional polysilicon TFT LCD, and FIG. 2B is a schematic diagram of the gate driver shown in FIG. 2A. Even if an inferior open occurs at the middle of the gate line, the redundancy function can be effective by driving the inferior gate line using the two gate drivers.

The gate driver includes a series of shift registers 22 and a buffer array 24 formed of inverter strings. If any one of the shift registers does not function properly, an erroneous voltage output from the malfunctioning shift register is applied to a respective gate line coupled thereto.

FIGS. 3A and 3B are graphs illustrating the effect an abnormal gate driver has on the picture quality of the LCD.

Here, reference numeral A represents the left input end of a gate line and reference numeral B represents the right input end of a gate line. In FIG. 3A, a dashed line (1) represents the voltage at position A of the gate line when the gate driver functions properly, and a solid line (2) represents the voltage at position A of the gate line when the gate driver does not function properly. In FIG. 3B, a dashed line (3) represents the voltage change according to the position of the gate line at t=t1 when the gate driver functions properly, and a solid line (4) represents the voltage change according to the position of the gate line at t=t1 when the gate driver does not function properly.

In FIG. 3A, when a gate driver located at the left of the gate line does not function properly, an erroneous voltage is applied to the input end A of the gate line. Here, a low level voltage is applied to the left end of the gate line at t=t1 even when a high level voltage should be applied to the gate line. Thus, as shown in FIG. 3B, the voltage at the left end of the gate line is less than a threshold voltage ($V_t$) which is required for the TFT of a pixel portion to be activated. Consequently, a good picture quality can not be displayed on the left side of the LCD.

According to the above-described example, the low level voltage is applied to the gate line when the gate driver does not function properly. Also, when a high level voltage, a mean voltage or a fluctuating voltage is applied, the picture quality is deteriorated.

SUMMARY OF THE INVENTION

It is an object of the present invention to provide a liquid crystal display (LCD) which minimizes the effect of the abnormal operation of a gate driver, subsequently providing a redundancy effect.

According to an aspect of the present invention, there is provided a liquid crystal display (LCD) in which one gate line is driven by both left and right gate drivers, comprising a couple of switching means which are placed between the gate driver and gate line, the couple of switching means being activated and deactivated by switching control signals to switch the output of the gate driver.

Preferably, the couple of switching means comprise transmission gate arrays for receiving the signal output from the gate drivers, the transmission gate arrays being activated and deactivated by using switching control signals applied from the outside as a clock signal. Also, the switching control signals are applied to the couple of switching means by one selected from the group consisting of a separate pad, high-state voltage ($V_{dd}$) supplying pad and low-state voltage ($V_{ss}$) supplying pad.

It is another object of the present invention to provide an LCD which discriminates whether or not a gate driver functions properly in order to prevent the output of a gate driver, which does not function, from being applied to the gate line.

According to another aspect of the present invention, there is provided an LCD having gate drivers for designating a gate line on which a data signal is loaded, a data driver for designating a column line, and a display panel having n gate lines, comprising: switching control means for outputting switching control signals by receiving a signal output from the final port of the gate driver; and switching means which is placed between the gate line and gate driver, for switching the output of the gate driver by using the output from the switching control means as a clock signal.

Preferably, the couple of switching means comprise transmission gate arrays for receiving the signal output from the gate drivers, the transmission gate arrays being activated and deactivated by using switching control signals applied from the outside as a clock signal.

Preferably, the switching control means comprises: two M-bit counters each receiving the output and start signals from the final port of the gate driver; a latch portion including M latches, which is connected to the output of the first counter and use the most significant bit of the output of the second counter as a clock signal; and an AND gate receiving M signals output from the latch portion.

According to the present invention, abnormal voltage of the gate driver is switched to prevent it from being transferred to the gate line, so that the LCD can function properly even though only one gate line operates. Also, the LCD of the present invention can discriminate whether or not the gate driver operates, so that it is not necessary to control an external switching operation, thus reducing the number of input pads.

BRIEF DESCRIPTION OF THE DRAWINGS

The above objects and advantages of the present invention will become more apparent by describing in detail preferred embodiments thereof with reference to the attached drawings in which.

DETAILED DESCRIPTION OF THE INVENTION

Figure 1A:
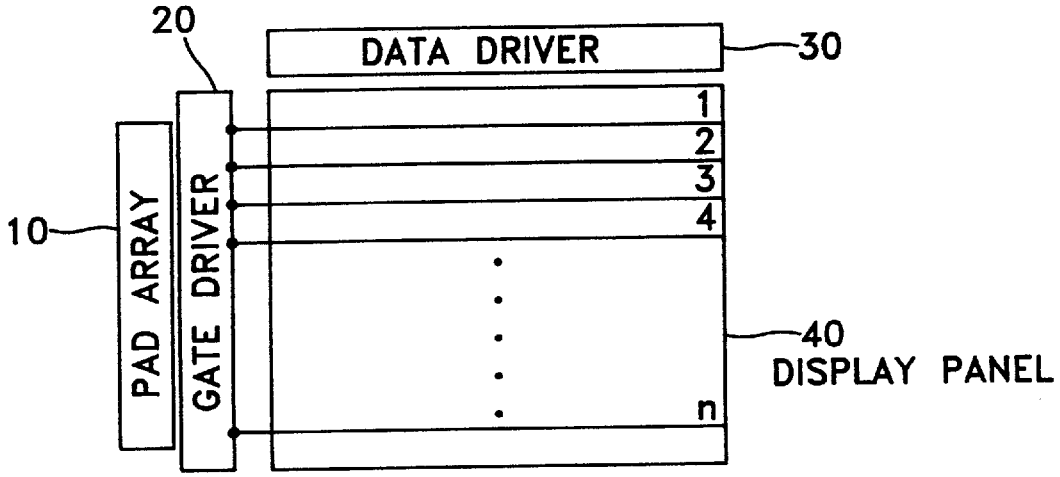
FIG. 1A (PRIOR ART)
FIGS. 1A and 1B are block diagrams of a conventional polysilicon TFT LCD.
Figure 1B:
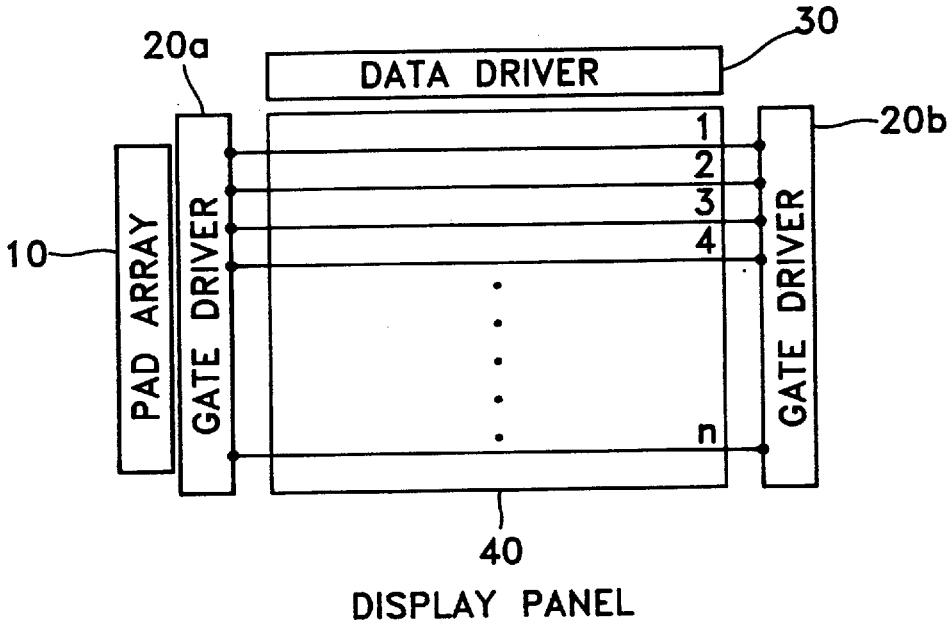
FIG. 1B (PRIOR ART)
Figure 2A:
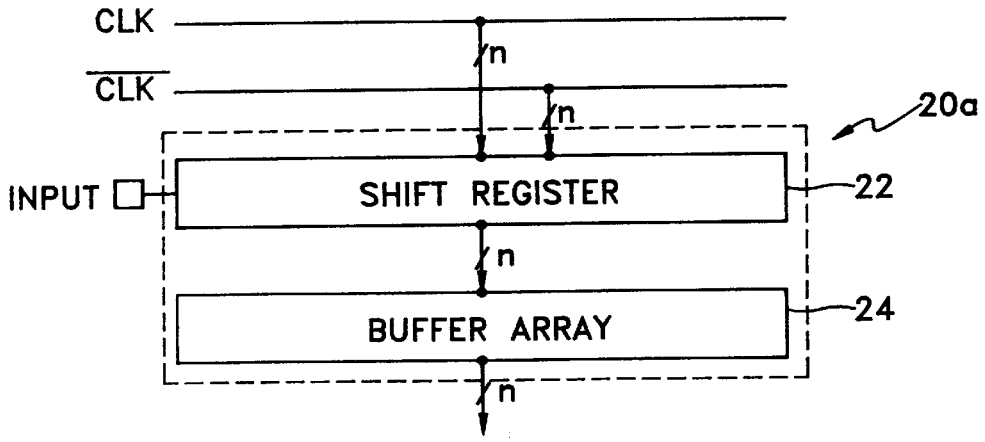
FIG. 2A (PRIOR ART)
FIG. 2A is a block diagram of a typical gate driver of the conventional polysilicon TFT LCD shown in FIGS. 1A and 1B.
Figure 2B:
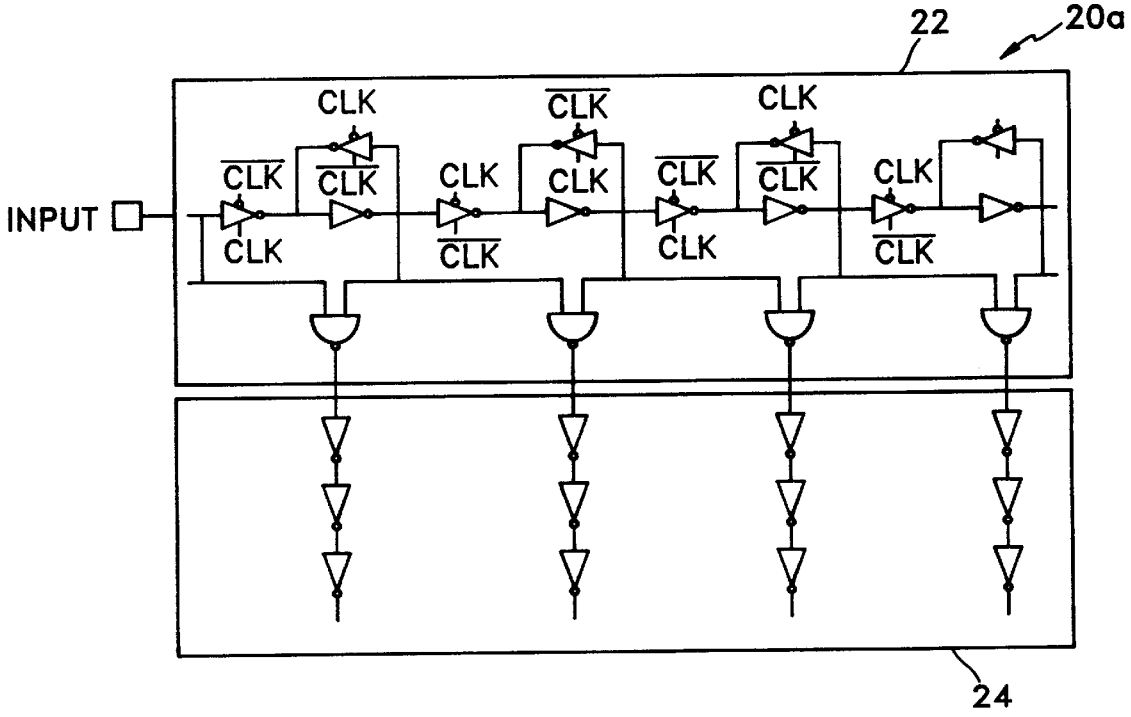
FIG. 2B (PRIOR ART)
FIG. 2B is a circuit diagram of the gate driver shown in FIG. 2A.
Figure 3A:
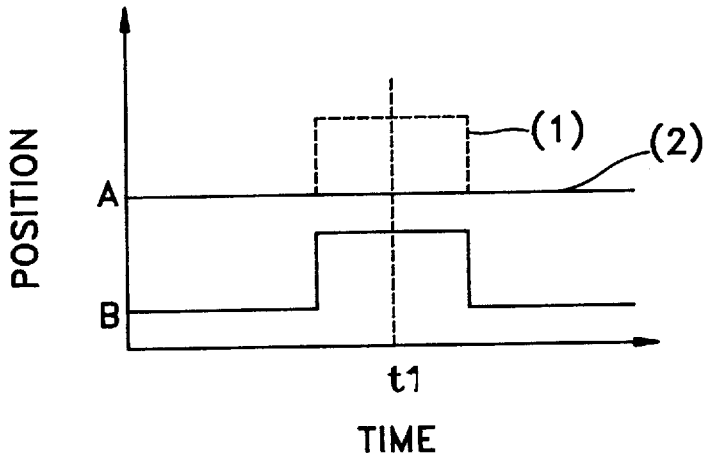
FIG. 3A (PRIOR ART)
FIGS. 3A and 3B are graphs illustrating the effect an abnormal gate driver has on the picture quality of the LCD shown in FIG. 1B.
Figure 3B:
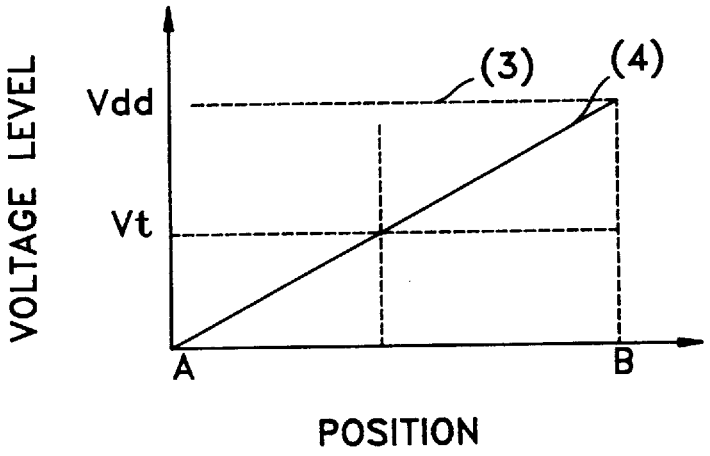
FIG. 3B (PRIOR ART)
Figure 4:
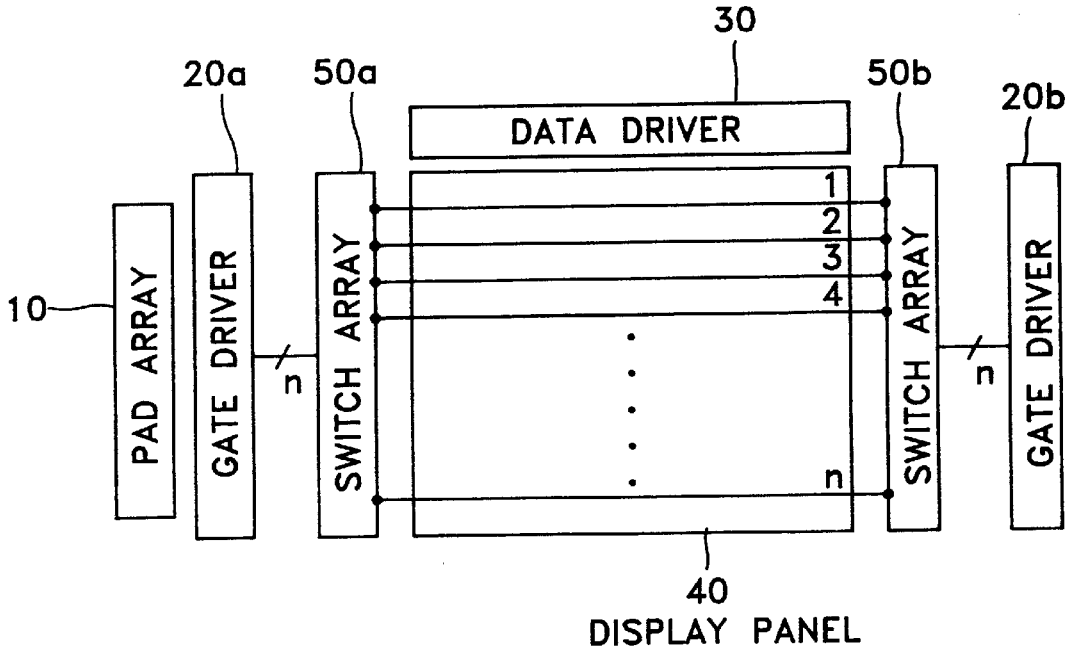
FIG. 4 is a block diagram of an LCD according to a preferred embodiment of the present invention.

In FIG. 4, reference numeral 10 represents a pad array, reference numerals 20*a* and 20*b* represent gate drivers which designate a gate line in which a data signal is driven, reference numeral 30 represents a data driver which designates a column line, reference numeral 40 represents a display panel constituted by n gate lines, and reference numerals 50*a* and 50*b* represent switch arrays for switching the output signals of the gate drivers.

Referring to FIG. 4, the gate drivers 20*a* and 20*b* are connected to the left and right ends of the gate lines, and the switch arrays 50*a* and 50*b* are connected between each gate driver and the gate lines.

The switch arrays 50*a* and 50*b* switch the output signal of the gate drivers according to a switching control signal. When one of gate drivers does not function, the switch array connected to the gate driver which does not function is deactivated, thereby preventing an abnormal voltage from being transferred to the gate line.

For example, when the gate driver 20*a* does not operate, the left switch array 50*a* is deactivated and only the right switch array 50*b* is activated. Thus, the gate lines are driven by the right gate driver 20*b,* thereby activating the display panels 40. That is, the LCD panel can function properly even when only one of the gate drivers functions properly, so that yield can be doubled.

Figure 5:
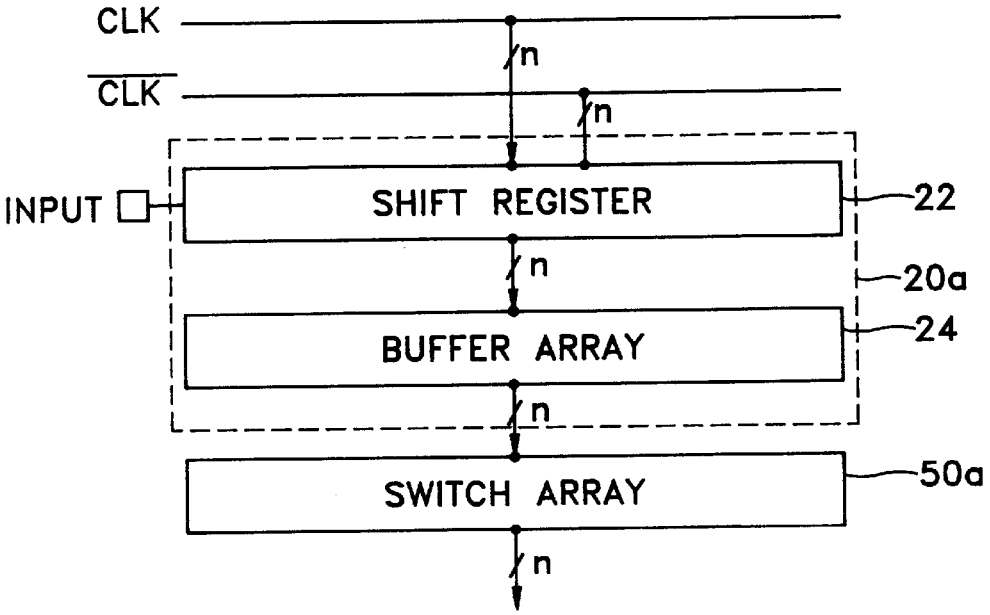
FIG. 5 is a block diagram of a gate driving circuit installed in the LCD shown in FIG. 4.
Figure 6:
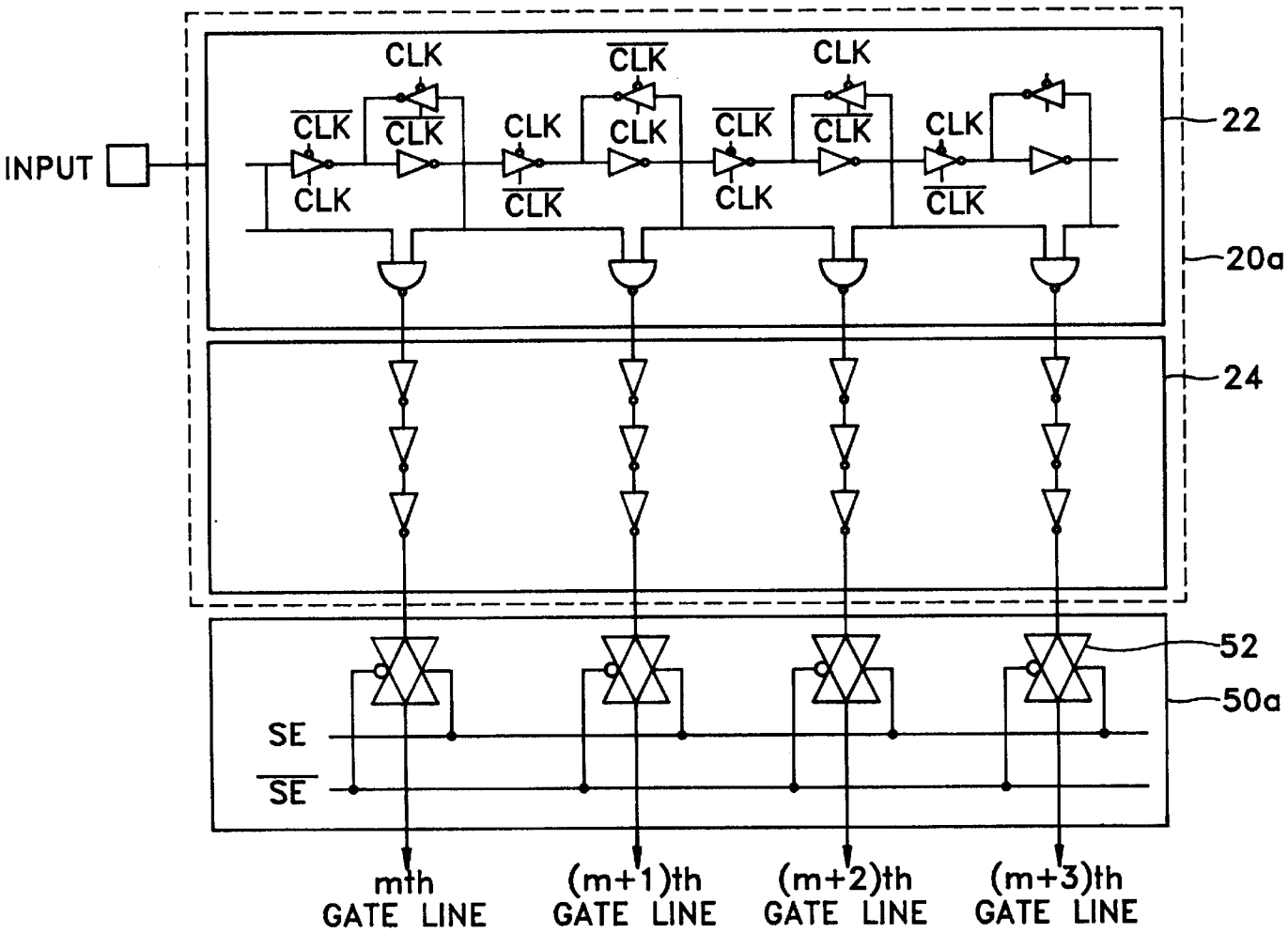
FIG. 6 is a schematic diagram of the gate driving circuit shown in FIG. 5.

FIG. 5 is a block diagram of a gate driving circuit installed in the LCD according to a preferred embodiment of the present invention, and FIG. 6 is a schematic diagram of the gate driving circuit shown in FIG. 5.

The gate driving circuit of the present invention comprises a gate driver 20*a* including shift registers 22, buffer array 24, and switch array 50*a* which is located between each buffer array and the gate lines, and activated or deactivated according to a switching control signal as a clock signal, to switch the output of the buffer array 24.

The switch array 50*a* includes transmission gate arrays 52 for receiving the signal output from the gate drivers, the transmission gate arrays being activated or deactivated by using switching control signals, that is, a switch enable (SE) or switch disable ($\overline{SE}$) signal, as a clock signal. Only when the switching control signal SE is high, the output signal of the gate driver is applied to the gate line via the transmission gates 52. Here, the transmission gates 52 may be constituted by N-type or P-type TFTs.

The switching control signal may be applied using an separate external pad (PAD), or a conventional high-state voltage ($V_{dd}$) or low-state voltage ($V_{ss}$) supplying pad.

According to the present invention, when any one of the gate drivers does not function properly, the switch array 50*a* located near the gate driver having the operational problem is deactivated using a switch disable signal $\overline{SE}$. Thus, it can be prevented that the abnormal voltage of the gate driver is applied to the gate line. As a result, even when only one of the gate drivers operates, the display panel can function properly, thus providing a redundancy effect.

Figure 7:
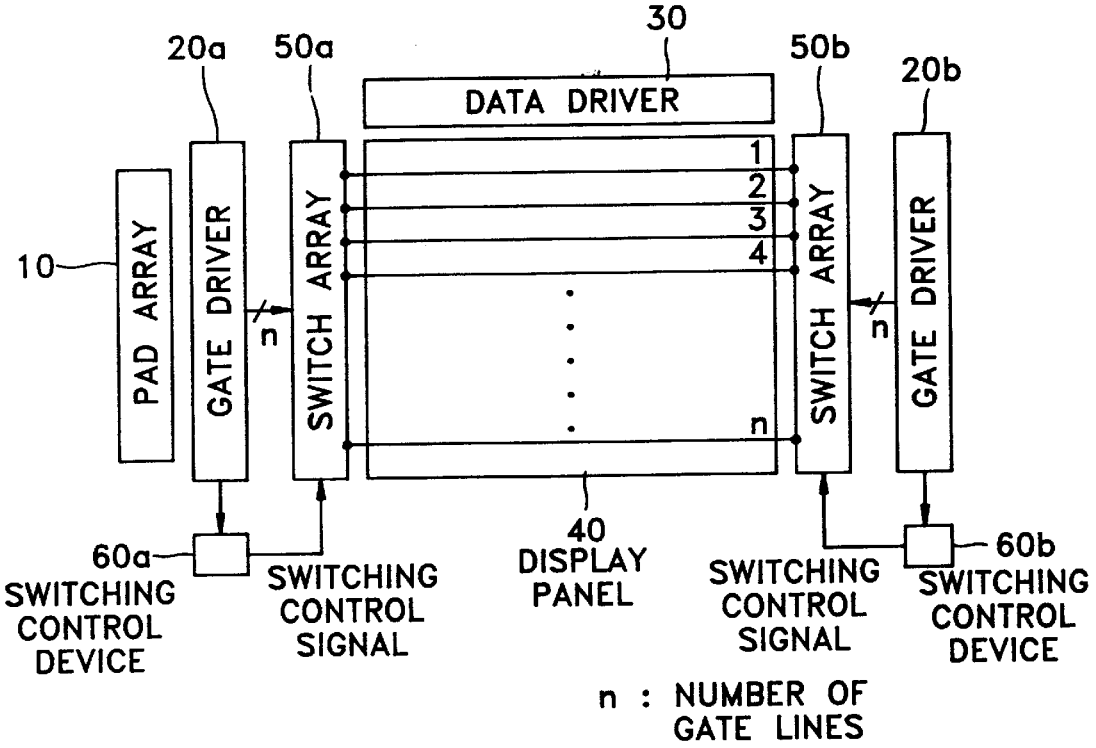
FIG. 7 is a block diagram of a LCD according to another preferred embodiment of the present invention.

FIG. 7 is a block diagram of a polysilicon TFT LCD according to another preferred embodiment of the present invention.

In FIG. 7, reference numeral 10 represents a pad array, reference numerals 20*a* and 20*b* represent gate drivers which designate a gate line in which a data signal is driven, reference numeral 30 represents a data driver which designates a column line, reference numeral 40 represents a display panel constituted by n gate lines, reference numerals 50*a* and 50*b* represent switch arrays for switching the output signals of the gate drivers, and reference numerals 60*a* and 60*b* represent switching control devices which determine whether or not the gate driver operates to generate switching control signals.

Referring to FIG. 7, the gate drivers 20*a* and 20*b* are connected to the left and right ends of the gate lines and the switch arrays 50*a* and 50*b* are connected between each gate driver 20*a* and 20*b* and the gate lines. Also, the switching control devices 60*a* and 60*b* are connected to the gate drivers 20*a* and 20*b,* and the switch arrays 50*a* and 50*b*.

The switching control devices 60*a* and 60*b* determine whether or not the gate drivers 20*a* and 20*b* function properly and whether to activate or deactivate the corresponding switch array 50*a* or 50*b* and then applies the switching control signals to the switch arrays 50*a* and 50*b*.

The operation of the switch arrays 50*a* and 50*b* is the same as that of the first preferred embodiment of the present invention.

Figure 8:
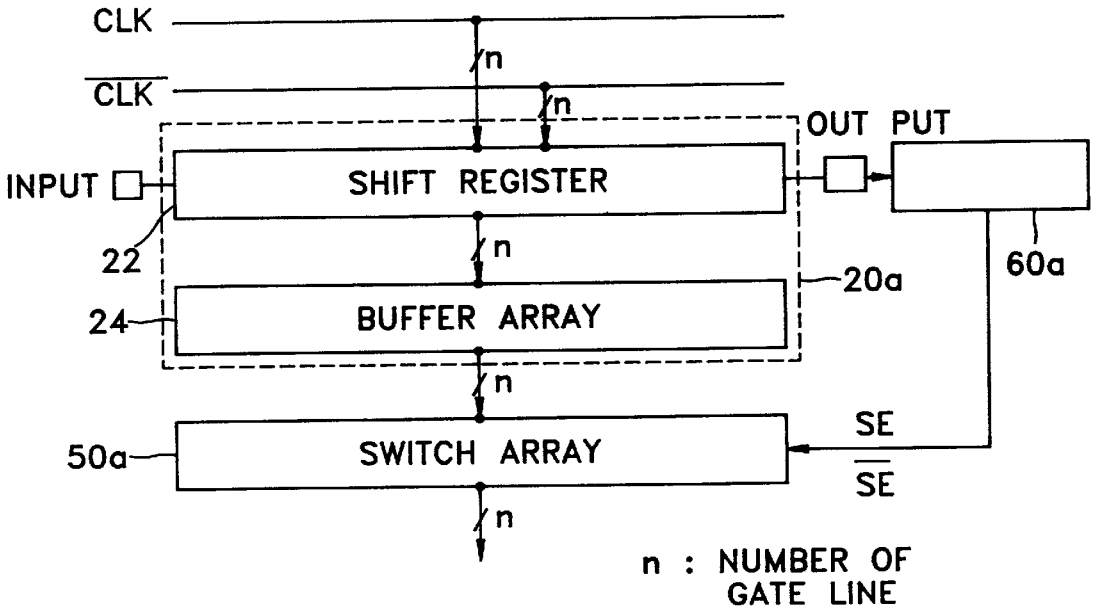
FIG. 8 is a block diagram of a gate driving circuit installed in the LCD shown in FIG. 7.

FIG. 8 is a block diagram of a gate driving circuit installed in the LCD shown in FIG. 7.

The gate driving circuit is constituted by shift registers 22, buffer array 24 and switch array 50*a* which is located between each buffer array and the gate lines, and is activated or deactivated according to a switching control signal as a clock signal, to switch the output of the buffer array 24, and switching control devices 60*a* and 60*b* (see FIG. 7) which determine whether or not the shift registers 22 operate by receiving the output signals from the shift registers 22 and applying the switching control signals to the switch array 50*a*.

Referring to FIGS. 7 and 8, the gate drivers 20*a* and 20*b* are connected to the left and right ends of the gate lines and the switch arrays 50*a* and 50*b* are connected between each gate driver 20*a* and 20*b* and the gate lines, and switching control devices 60*a* and 60*b*, having a self-checking function, are connected to the gate drivers 20*a* and 20*b*. When one of the gate drivers 20*a* or 20*b* does not function properly after determining whether the gate drivers 20*a* and 20*b* function properly or not, the switch array connected to the gate driver 20*a* or 20*b* having the operational problem is deactivated, thereby preventing the abnormal voltage of the gate driver 20*a* or 20*b* from being applied to the gate lines.

Thus, even when only one gate driver 20*a* or 20*b* functions properly, the LCD can operate, thereby doubling the yield. Also, there is no need for externally controlling the activation and deactivation of the switch arrays 50*a* and 50*b*. As a result, an external input signal for controlling the activation and deactivation of the switch arrays 50*a* and 50*b* is not required, thereby reducing the number of input pads.

Figure 9:
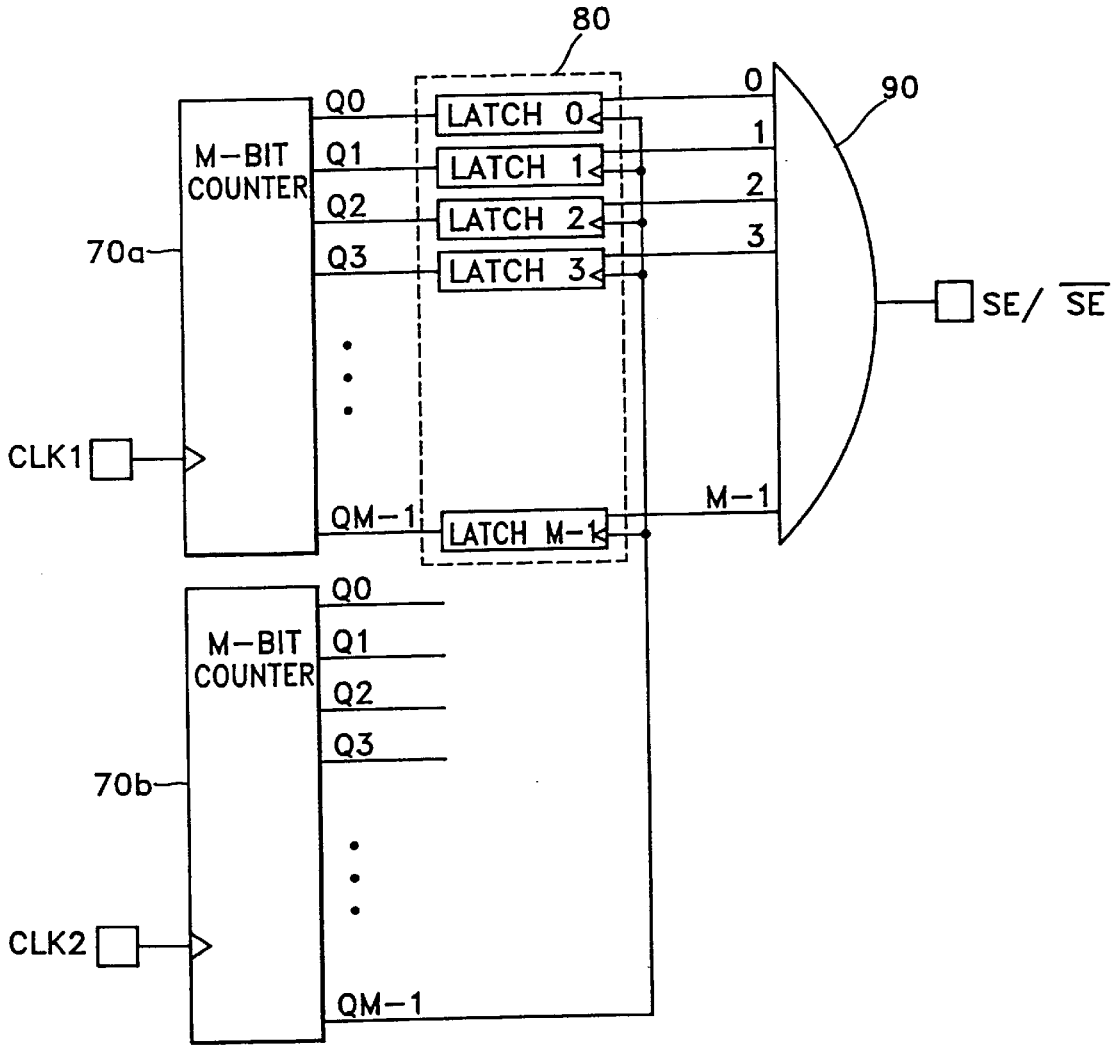
FIG. 9 is a block diagram of a switching control device shown in FIG. 8.

FIG. 9 shows an example of a switching control device 60*a*, 60*b* used in the present invention.

The switching control device 60*a*, 60*b* comprises first and second M-bit counters 70*a* and 70*b* each having M output signals, a latch portion 80 each including M latches each receiving one of the M signals as its input and the most significant bit (MSB) from output signals of the second counter 70*b* as its clock signal, and an AND gate 90 receiving output of the M latches.

Figure 10:
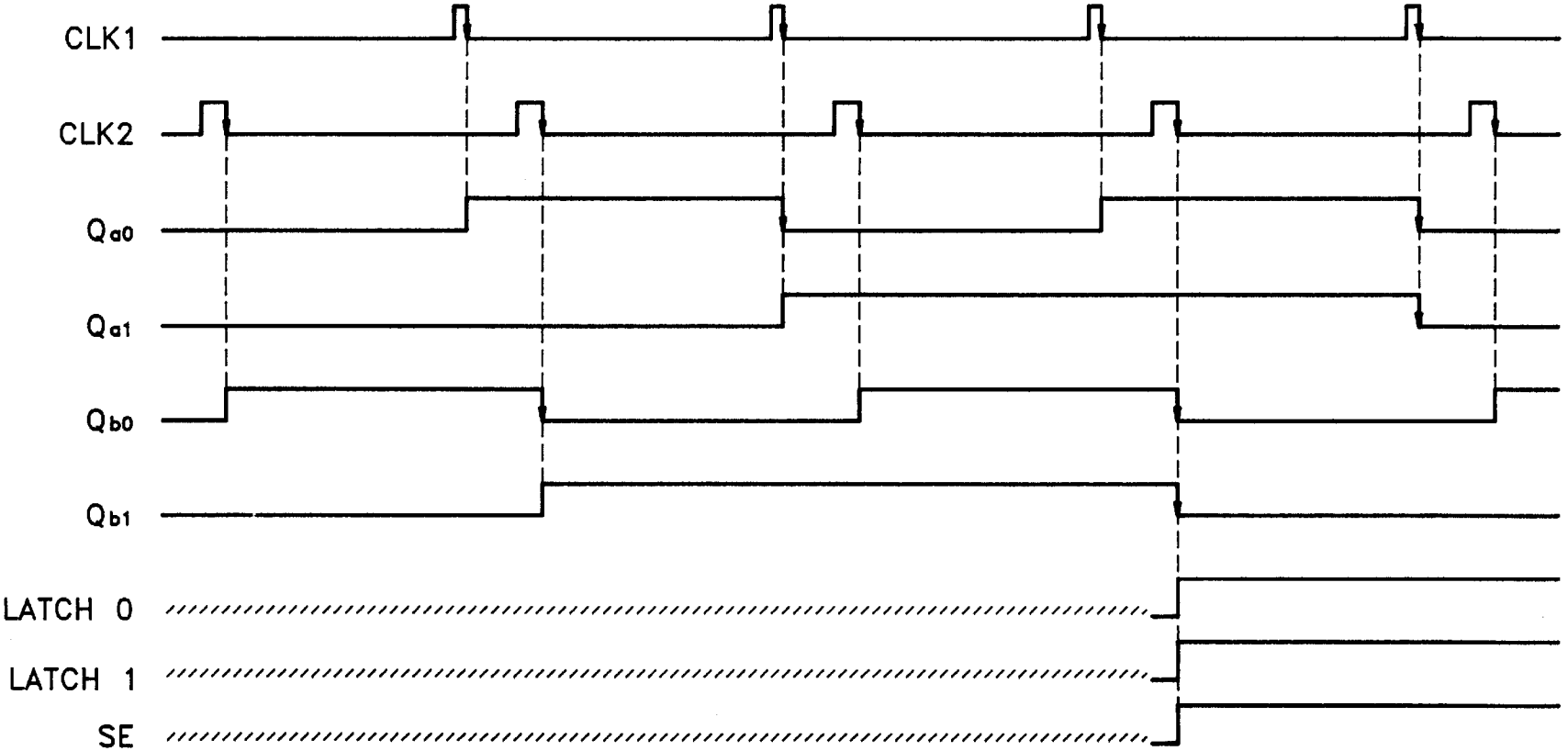
FIG. 10 is a timing diagram of the switching control device shown in FIG. 9.

FIG. 10 is a timing diagram of the switching control device shown in FIG. 9, wherein a 2-bit counter (M=2) is used.

In FIG. 10, CLK1 represents a clock signal input to the first counter 70*a* which receives the output signals from the final port of the shift registers 22 (i.e., OUTPUT), CLK2 represents a clock signal input to the second counter 70*b* which receives start signals from the shift registers 22 (i.e., INPUT). The signal $Qa_{ao}$ represents a first output signal of the first counter 70*a*, $Q_{a1}$ represents a second output signal of the first counter 70*a*, $Q_{b0}$ represents a first output signal of the second counter 70*b*, $Q_{b1}$ represents a second output signal of the second counter 70*b*, and SE represents a switching control signal output from the AND gate 90.

Referring to FIGS. 9 and 10, the operation of the switching control device of the present invention will be described.

First, the output and start signals from the output and input ports of the shift register 22 shown in FIG. 8 are input to first and second M-bit counters 70*a* and 70*b* (M=2) as a clock signal.

After counting the output and start signals from the final port of the shift register 22, the output from the first counter 70*a* is input to the latch portion 80. The most significant bit (MSB) of the output signals from the second counters 70*b* which counts the start signal of the shift register (INPUT) is used as a clock signal of the latch portion 80.

The output signals of the latch portion 80 is input to the AND gate 90, and the output from the AND gate 90 is used as an enable and disable signal for controlling activation and deactivation of the switch array 50*a* (see FIG. 8). Here, when M=1, the output from the latch portion 80 may be directly used as an enable and disable signal of the switch arrays 50*a* and 50*b*.

In the above-described LCD and driving method therefor according to the present invention, the switch arrays 50*a* and 50*b* are disposed between each gate driver 20*a* and 20*b* and the gate lines. Here, when one of the gate drivers 20*a* or 20*b* does not operate, the switch array 50*a* or 50*b* near the gate driver 20*a* or 20*b* which does not operate is deactivated, thereby preventing an abnormal voltage of the gate driver 20*a* or 20*b* from being transferred to the gate lines. Thus, the display panel can function properly even when only one of the gate drivers 20*a* or 20*b* operates, thus improving the yield of the product.

Also, there is a control circuit for determining whether the gate driver 20*a* or 20*b* operates or not to control activation or deactivation of the switch arrays 50*a* and 50*b*. Also, there is no need for externally controlling the activation and deactivation of the switch arrays 50*a* and 50*b*. As a result, an external input signal for controlling the activation and deactivation of the switch arrays 50*a* and 50*b* is not required, thereby reducing the number of input pads.

The present invention is not limited to the particular forms illustrated and further modifications and alterations will occur to those skilled in the art.

What is claimed is:

1. A liquid crystal display device, comprising:

a plurality of rows of display cells;

a plurality of gate lines, each of said gate lines connected to a respective row of display cells in the plurality thereof;

means for driving first and second ends of each of said plurality of gate lines with respective gate line driving signals; and a first switch array, electrically coupled between first ends of said plurality of gate lines and said driving means, which disables transfer of the gate line driving signals from said driving means to the first ends of said plurality of gate lines in response to a first switch disable signal.

2. The display device of claim 1, wherein said driving means comprises a first shift register to retain the gate line driving signals and a first buffer array electrically coupled between the first shift register and said first switch array.

3. The display device of claim 2, wherein said first switch array comprises a first array of transmission gates electrically coupled in series between the first buffer array and the first ends of said plurality of gate lines.

4. The display device of claim 3, further comprising a second switch array, electrically coupled between the second ends of said plurality of gate lines and said driving means, which disables transfer of the gate line driving signals from said driving means to the second ends of said plurality of gate lines, in response to a second switch disable signal.

5. The display device of claim 2, further comprising a second switch array, electrically coupled between the second ends of said plurality of gate lines and said driving means, which disables transfer of the gate line driving signals from said driving means to the second ends of said plurality of gate lines, in response to a second switch disable signal.

6. The display device of claim 5, wherein said driving means comprises a second shift register to retain the gate line driving signals and a second buffer array electrically coupled between the second shift register and said second switch array.

7. The display device of claim 6, wherein said first switch array comprises a first array of transmission gates electrically coupled in series between the first buffer array and the first ends of said plurality of gate lines; and wherein said second switch array comprises a second array of transmission gates electrically coupled in series between the second buffer array and the second ends of said plurality of gate lines.

8. A liquid crystal display device, comprising:

a plurality of rows of display cells:

a plurality of gate lines, each of said gate lines connected to a respective row of display cells in the plurality thereof;

means for driving first and second ends of said plurality of gate lines with respective gate line driving signals;

a first switch array, electrically coupled between first ends of said plurality of gate lines and said driving means, which disables transfer of the gate line driving signals from said driving means to the first ends of said plurality of gate lines in response to a first switch disable signal;

a second switch array, electrically coupled between the second ends of said plurality of gate lines and said driving means, which disables transfer of the gate line driving signals from said driving means to the second ends of said plurality of gate lines in response to a second switch disable signal; and switching control means, coupled between said driving means and said first and second switch arrays, for generating the first and second disable signals.

9. The display device of claim 8, wherein said switching control means comprises:

a first M-bit counter responsive to a first output of said driving means;

a first plurality of latches having data inputs electrically coupled to outputs of the first M-bit counter; and a first AND gate having inputs electrically coupled to outputs of the first plurality of latches and an output electrically coupled to the first array of transmission gates.

10. The display device of claim 9, further comprising a second M-bit counter coupled to said driving means; and wherein the first plurality of latches have clock inputs electrically coupled to an output of the second M-bit counter.

11. The display device of claim 10, wherein said switching control means comprises:

a third M-bit counter responsive to a second output of said driving means;

a second plurality of latches having data inputs electrically coupled to outputs of the third M-bit counter; and a second AND gate having inputs electrically coupled to outputs of the second plurality of latches and an output electrically coupled to the second array of transmission gates.

12. The display device of claim 11, further comprising a fourth M-bit counter coupled to said driving means; and wherein the second plurality of latches have clock inputs electrically coupled to an output of the fourth M-bit counter.

* * * * *